United States Patent [19]

Lehmann et al.

[11] Patent Number: 4,640,216

[45] Date of Patent: Feb. 3, 1987

[54] DEVICE FOR REDUCING VIBRATIONS OF PERISCOPES

[75] Inventors: Eike Lehmann, Mühlenberg; Reiner Jannusch, Bergenring, both of Fed. Rep. of Germany

[73] Assignee: Howaldtswerke-Deutsche Werft, Aktiengesellschaft, Hamburg und Kiel, Fed. Rep. of Germany

[21] Appl. No.: 704,391

[22] Filed: Feb. 22, 1985

[30] Foreign Application Priority Data

Sep. 12, 1984 [DE] Fed. Rep. of Germany ..... 3433397

[51] Int. Cl.[4] ..... B63G 8/38

[52] U.S. Cl. ..... 114/340; 52/1; 188/379; 188/380

[58] Field of Search ..... 114/339, 340; 244/75 A; 52/1; 188/378-380

[56] References Cited

U.S. PATENT DOCUMENTS

| | | | |
|---|---|---|---|
| 2,154,442 | 4/1939 | Diehl | 188/378 |
| 2,586,043 | 2/1952 | Hodgson et al. | 244/75 A |
| 3,174,589 | 3/1965 | Chen | 52/1 X |
| 3,804,210 | 4/1974 | Erickson | 188/379 |
| 3,826,340 | 7/1974 | Brokaw | 188/378 |
| 4,320,602 | 3/1982 | Richardson | 52/1 |

FOREIGN PATENT DOCUMENTS

| | | | |
|---|---|---|---|
| 1509022 | 1/1969 | Fed. Rep. of Germany | 52/1 |
| 2317840 | 10/1974 | Fed. Rep. of Germany . | |
| 2806757 | 8/1979 | Fed. Rep. of Germany . | |
| 3214181 | 11/1983 | Fed. Rep. of Germany . | |
| 2012217 | 1/1979 | United Kingdom | 114/340 |

OTHER PUBLICATIONS

Stop-choc Schwingungstechnik GmbH & Co KG, 8/79, *ARDAMP Hydrodynamische Dämpfer, Reihe,* E1FH 781.

"U-Bootbau", Ulrich Gabler, 1978, Wehr and Wissen, pp. 57-59.

*Primary Examiner*—Sherman D. Basinger

*Attorney, Agent, or Firm*—Nils H. Ljungman

[57] ABSTRACT

The invention relates to an apparatus for damping vibrational deflections of periscopes or other vessel devices, which periscopes or other vessel devices extend into an aqueous medium when in use. Particular uses for the damping apparatus include application to periscopes, antennas and the like, for submarines. The damping apparatus preferably comprises a damping mass suitably mounted on a periscope or other extended-in-use device by damping elements. The damping elements may include, for example, elastic springy elements having a high internal friction, friction dampers, and coil springs which dissipate vibrational energy. The damping mass moves in response to vibrations of the damped device, thereby functioning as a kinetic energy storing device. The damping elements interact with the movement of the damping mass and thereby function as potential energy storing means. The damping apparatus damps the vibrational deflections of the device, which extends into the aqueous medium during movement of a vessel therethrough, thereby improving the performance of the extending device.

21 Claims, 14 Drawing Figures

DEVICE FOR REDUCING VIBRATIONS OF PERISCOPES

BACKGROUND OF THE INVENTION

1. Field of the Invention

The present invention relates to an apparatus for reducing the vibrations of periscopes and other vessel devices which extend into a liquid medium when in use. More specifically, the present invention relates to an apparatus for reducing the vibrations of submarine's periscopes and other extended-in-use vessel devices, by means of a damping arrangement, wherein the vibrations are induced by the relative movement of the submarine or vessel with respect to the liquid medium.

2. Description of the Prior Art

When periscopes or other similar vessel devices, which are extended in use, are moved through water, the devices may have vibrations set up therein which impair that use. These vibrations may also render the use of the devices impossible. One cause of these vibrations has been determined to result from the separation of vortices. Under certain conditions, a Kármán vortex path can form. The formation and magnitude of vortices depend upon parameters which may include the diameter of the periscope or tubular device, the approach velocity and the temperature-dependent viscosity of the water. Other factors influencing the formation of vortices include other contemporaneously extended apparatuses and turbulence produced by a submarine's other devices which extend into the water including, for example, turbulence produced by the submarine's conning tower. With increasing velocity of the periscope or other extended-in-use device with respect to the water, the frequency of the vortex will increase. As the natural frequencies, including the fundamental frequency, are approached, resonant vibrations will occur which may impair the functionality of the device. The resonant vibrations will persist as the relative velocity increases beyond that corresponding to the natural frequency. Thus, in the case of a periscope, its functionality will remain impaired over a wide velocity range for which its utilization is required.

Vibrations caused by vortices can be classified according to three general categories, as follows: (1) deflections parallel to the direction of travel; (2) lateral deflections perpendicular to the direction of travel; and (3) deflections intermediate between the directions of parallel to and perpendicular to travel. Lateral vibrations perpendicular to the direction of travel will generally be of a greater magnitude than vibrations parallel to the direction of travel, since the vortices alternately dissipate and reform on each side of the extended-in-use device. For example, for a periscope having an extended free length of about 4.2 meters and traveling at a certain speed, lateral deflections of ±40 mm were observed. The observed lateral deflections correspond to an acceleration of 10 g. Deflections parallel to the direction of travel of ±8 mm were observed. The frequency of the observed vibrations was between 7 and 8 Hz. Vibrations of the periscope, as just described, have a detrimental effect on the periscope optical system whereby accurate observations cannot be attained.

Proposals have already been made for the damping of tall, slender structures, such as smoke stacks or masts, where the vibration is due to wind. Such proposals include German Patent Publications DE-AS No. 28 06 757 and DE-PS No. 32 14 181, which disclose the installation of annular damping weights by means of spring elements or vibration-damping elements close to the top ends of the structures. These proposals are not transferable to periscopes or similar devices on submarines for which the vibrations are produced by the streaming of water and for which special conditions pertaining to submarines must be observed.

A proposal has also previously been made to reduce the vibrations of extendible antenna supports for submarines. In particular, German Patent Publication DE-AS No. 23 17 840 discloses a proposal providing a tubular antenna support with a similarly extendible, streamlined cover. An undesirable aspect of this proposal is that the cover impairs the provision of a rigid seating for the portion of the antenna extending above the tower. Therefore, in this example of background art, an additional provision was made to attach the antenna carrier upper support via a traverse or cross-tie rod to a fixed guide, wherein the traverse is located inside the extendible cover. The traverse moves along the fixed guide as the antenna is extended. Although the streamlined cover can exert a favorable influence on the vortex formation, it cannot prevent the occurrence of vibrations for all conditions encountered in the operation of a submarine. The drawbacks associated with this proposal are the high costs for the extendible cover, the traverse rod and the fixed guide assembly, the low stiffness of the upper support near the traverse, and the elevation of the center of gravity of the submarine resulting from the additional elements.

OBJECTS OF THE INVENTION

It is an object of this invention to provide an apparatus whereby the vibrations which occur in a periscope or other vessel device which is extended into a liquid medium when in use are significantly reduced or prevented.

It is also an object of this invention to provide an apparatus for reducing or preventing vibrations of a periscope or other device which extends from a submarine when in use, wherein the apparatus is of a simple construction whereby the apparatus can be mounted directly onto the periscope or other extended-in-use device.

It is a further object of this invention to provide an apparatus for reducing or preventing vibrations of a periscope or other device which extends from a submarine when in use, wherein the apparatus is of a simple design whereby the apparatus can be mounted as a subsequent addition to the periscope or other extendible device.

It is an additional object of this invention to provide an apparatus mounted on the periscope as described above which allows for the rotation, extension and retraction of the periscope or other extended-in-use device.

SUMMARY OF THE INVENTION

The present invention provides an apparatus for damping vibrations of a periscope or other device that, at least when in use, extends into a body of water from the superstructure of a submarine or other vessel and which accomplishes the aforementioned objects. Said damping apparatus is effective for damping vibrations resulting from vortices created due to movement of the periscope or other device through the water.

The damping apparatus, in essence, comprises a kinetic energy storing means and a potential energy storing means. The damping apparatus, preferably, comprises a damping mass suitably mounted on a periscope or other extended-in-use device in such a way that vibrational deflections of the damped device cause the damping mass to move. In this respect, the damping mass functions as a kinetic energy storing means. Means of mounting the damping mass preferably comprises a plurality of springy elements having elastic properties. The springy elements function as the means for storing potential energy. The springy elements may themselves be lossy, such that, energy transferred between the kinetic energy storing means and the potential energy storing means is dissipated during a transfer therebetween, or another means, such as, a damping oil or a friction pad, may provide the function of dissipating the energy transferred. Preferably, the damping apparatus is mounted at or near an upper end of the periscope. An optimal arrangement is one which provides for mounting the damping apparatus at the periscope's head, wherein the damping mass incorporates any devices which may be located at that position. Proportional to their respective masses, such incorporated devices can effectively function as part of the damping mass.

Other embodiments encompassed by the present invention include designs wherein the damping apparatus is mounted inside the periscope's head or inside an extendible tube which supports the periscope's head at a position immediately below the aforementioned head. Implementation of such embodiments would require considerable changes in the construction of the periscope in view of current designs. Consequently, for periscopes of conventional design, it is preferable to mount the damping apparatus below the periscope's head.

Appropriate means must be provided to support the portion of the periscope or other extended-in-use device which extends above the superstructure of the submarine. A plurality of support means may be employed.

The mass of the damping mass should preferably be between about 0.5% and 10% of the mass of the part of the periscope which extends above its uppermost support. An uppermost support comprising an annular bearing support which can be flush with, or can extend above, the superstructure of the submarine is typically provided. The damping mass is more preferably between about 1% and 5% of the mass of the part of the periscope which extends above its uppermost support and most preferably between about 1% and 3% of that mass.

Critical damping has been found to be an appropriate standard by which to measure the desired level of damping with respect to the present invention. It has been determined that the appropriate level of damping to be obtained is between about 10% and 30%, and preferably about 20%, of the critical damping. Subsequent adjustment of the apparatus to the disclosed damping levels optimizes damping over a frequency range which may include resonant frequencies produced by the damping apparatus itself in addition to the fundamental and natural frequencies of the damped device.

The external dimensions of the damping apparatus are chosen such that the apparatus can be drawn through the uppermost bearing located in the submarine's superstructure. Undesired impact between the damping mass and the periscope tube may occur when the damping apparatus is in an extended position due to radial motion of the damping mass relative to the periscope tube. Such radial motion may be induced by vortices or caused by other external forces. In order to limit this relative motion, bumpers may be provided between the periscope tube and the damping mass. The bumpers are designed to prevent the damping mass from damaging the periscope tube without increasing the diameter of the damping apparatus.

In preferred embodiments, the damping apparatus is of an external shape which minimizes the magnitude of the wake, or other turbulent water flow, which may extend from the water's surface down to the submarine's superstructure, behind the periscope when the submarine is traveling with the periscope in an extended position. Protective sheaths or jackets which surround the damping apparatus have been found to be useful for facilitating the flow of water past the apparatus and minimizing the magnitude of the wake. The protective sheaths or jackets simultaneously serve to protect the damping apparatus from damage. In one embodiment, the protective sheath forms a pressure-tight housing which contains a hydraulic damping medium such as silicone oil. Other damping mediums may also be used. In a second embodiment, the protective sheath contains openings through which ambient water may enter and exit. In this embodiment, the water itself acts as the damping medium.

In a third embodiment for facilitating the flow of water past the damping apparatus and minimizing the magnitude of the wake, the damping mass is rotatably mounted and constructed such that it automatically sets itself in the direction of travel independently of the rotation of the periscope. In descriptive terms, the damping mass can be said to operate like a vane.

DETAILED DESCRIPTION OF THE PREFERRED EMBODIMENTS

The elements of a damping apparatus according to the present invention essentially comprise a damping mass, means for damping the damping mass, means for attaching the damping means to the damping mass and means for attaching the damping apparatus to a periscope or other extended-in-use vessel device.

Figure 1:
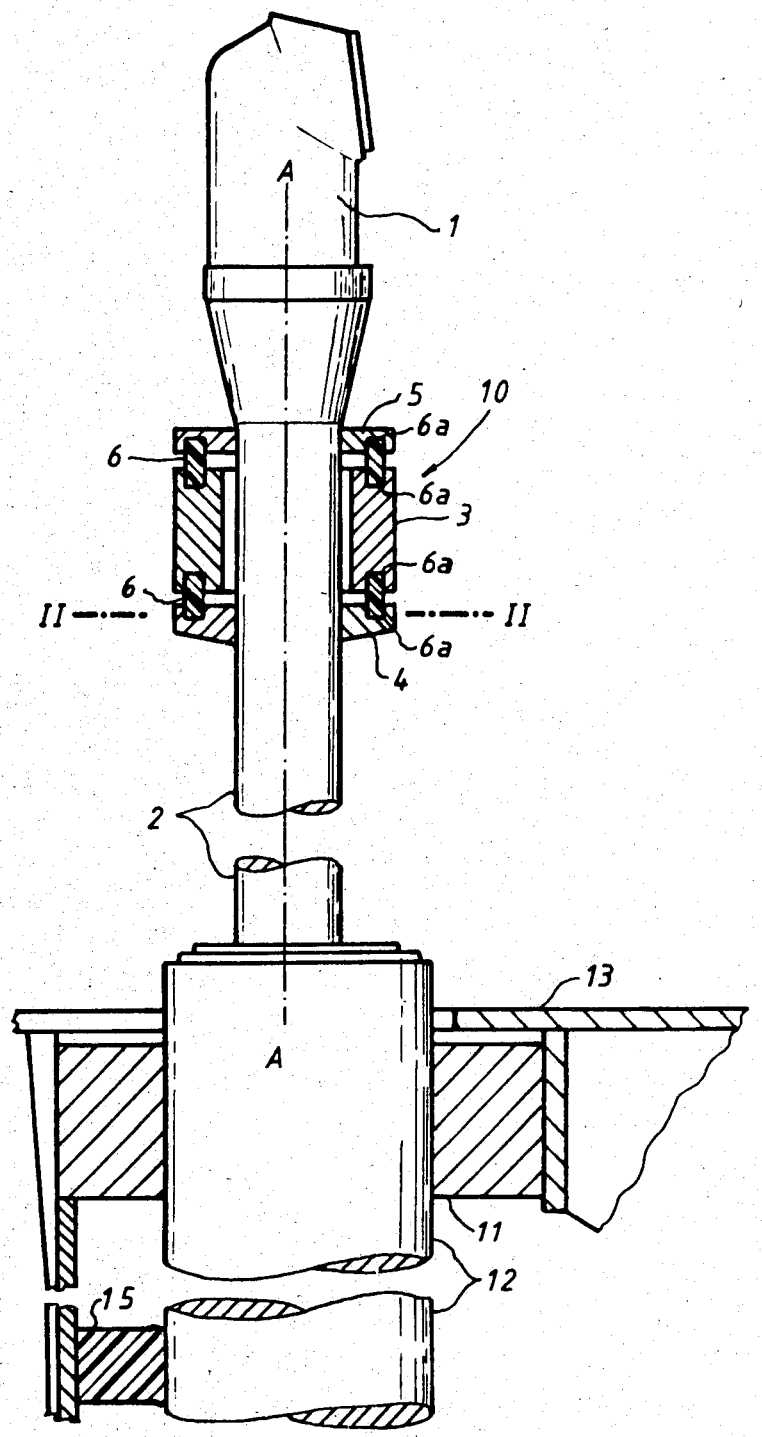
FIG. 1 shows a vertical cross-section of a damping apparatus mounted on a periscope wherein the damping apparatus has two attaching rings supporting a damping mass.

Referring to FIG. 1, a conventional periscope is shown having a periscope's head 1 mounted on an upper periscope tube 2 which is of a cylindrical geometry. The upper tube 2 is rotatably connected to a lower periscope tube 12 which has a larger diameter than the upper tube 2. When the periscope is extended, it is rotatably supported by an upper bearing 11 located immediately below the upper surface 13 of a submarine's superstructure or conning tower. The lower tube 12 may optionally pass through additional bearings, not shown. When the periscope is lowered to a fully retracted position, the periscope's head 1 is drawn through the top bearing 11 until the periscope's head 1 lies below the upper surface 13.

Still referring to FIG. 1, a damping apparatus 10 is mounted on the upper periscope tube 2 immediately below the periscope's head 1. The damping apparatus 10 comprises an annular damping mass 3 which is disposed between a lower attaching ring 4 and an upper attaching ring 5 by means of a plurality of springy elements 6 such that the damping mass is movable in any direction perpendicular to the axis, A—A, of the upper tube 2. The springy elements 6 permit limited motion of the damping mass 3 while acting in conjunction with the damping mass 3 to dampen the motion.

The springy elements 6 should be made from a material which is elastic and which exhibits high internal friction upon deformation. Natural and synthetic rubbers are examples of materials found to be suitable for application as springy elements. In other embodiments the springy elements 6 are comprised of a plurality of narrow wire strands wound together to form straight or helical springs, or hydrodynamic damped spring elements may be used. All materials used in connection with the damping device 10 should be corrosion and sea water resistant. A heavy metal, such as a lead alloy, is a preferred material for the damping mass 3. Other suitable substances include stainless steel and special metals such as bronze.

The springy elements 6 are set in recesses in the lower attaching ring 4, upper attaching ring 5 and damping mass 3 and held in place by a suitable securing means. Examples of the securing means include cementing the springy elements 6 in recesses 6*a* or pressing the springy elements 6 into recesses 6*a* which have slightly smaller diameters than the springy elements 6. Preferably, the springy elements 6 are cylindrical, have circular cross-sections and extend substantially parallel to the A—A axis of the periscope tube 2. Also preferably, the damping apparatus 10 has at least four (4) springy elements 6. However, in an alternate embodiment, the springy elements 6 could comprise a single springy element 6 which is disposed between the damping mass 3 and the upper periscope tube 2 and which is attached to both by a suitable securing means.

Figure 2:
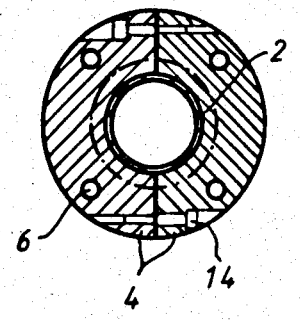
FIG. 2 shows a horizontal cross-section of an attaching ring corresponding to the II—II plane of FIG. 1.

The damping mass 3 and the lower and upper attaching rings 4, 5 each comprises two parts to facilitate mounting and dismounting of the damping apparatus 10 for purposes of installation and maintenance. The two-part construction of an attaching ring 4 is exhibited in FIG. 2. The attaching ring shown comprises two halves held together by screws 14 which also clamp the attaching ring 4 firmly onto the upper tube 2.

Referring back to FIG. 1, below the top bearing 11 is an annular, impact-resistant support 15 which abuts the damping apparatus 10, or a part thereof, when the periscope is in a retracted position. The support 15, which is preferably made from an elastic material, dampens any vibrations of the retracted periscope. The support 15 may optionally be mounted in such a way that it can be swung into position against the damping apparatus 10 when the periscope is in a retracted position.

For all embodiments disclosed herein, the external dimensions of the damping apparatus at all angular positions should be less than the internal diameter of the top bearing 11, so that the damping apparatus can be retracted to a position below the upper surface 13 of the submarine's superstructure.

Figure 3:
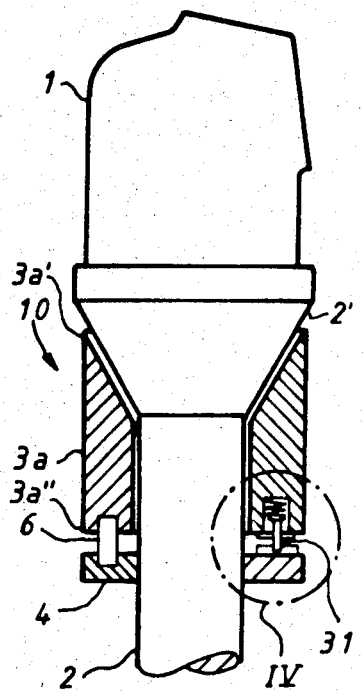
FIG. 3 shows a vertical cross-section of a damping apparatus wherein the damping apparatus has one attaching ring supporting a damping mass and wherein damping is aided through the utilization of friction dampers.

Referring to FIG. 3, disclosed is a damping apparatus 10 wherein a damping mass 3*a* is supported from below by a lower attaching ring 4. The damping mass 3*a* has a distinct top end 3*a*′ and a bottom end 3*a*″. The top end 3*a*′ is conically designed to partially enclose a conically shaped section of the upper periscope tube 2′.

FIG. 3 also discloses a damping apparatus 10 wherein a friction damper 31 substituted for a springy element 6. Referring to the expanded view of the friction damper 31 in FIG. 4, a friction pad 42 is located on the lower attaching ring 4. The friction pad 42 may be made of a polytetrafluoroethylene, such as Teflon, a registered trademark, manufactured by the Dupont Company, or other substance having similar properties. A circular friction shoe 43 is pressed against the friction pad 42 by a pin 44 which is recessed into and perpendicularly extends up from the shoe 43. The pin 44 is recessed in the shoe 43 so as to prevent displacement. The pin 44 is acted on by a pressure spring 45 housed in a recess 46 in the damping mass 3. The pin 44 passes through a hole 47′ in an annular plate 47 which covers the recess 46. Referring back to FIG. 3, the springy elements 6 are loaded in a tension-creating manner so as to draw the damping mass 3*a* toward the attaching ring 4. In addition to damping the movement of the damping mass 3*a*, the friction dampers 31 limit the damping mass 3*a* to movement in essentially radial directions. Alternatively, friction dampers which utilize permanent or adjustable magnets rather than helical springs to damp motion between the damping mass 3 and attaching ring 4 may be used.

Figure 4:
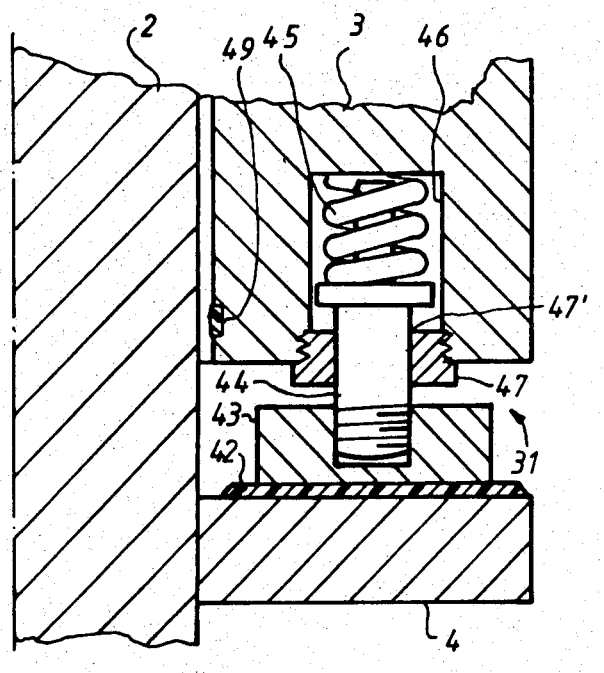
FIG. 4 shows an expanded view of the friction damper denoted IV in FIG. 3.

FIG. 4 additionally discloses bumpers 49 made of thin rubber or leather inserts which are attached to the damping mass 3 next to the upper periscope tube 2. The purpose of the bumpers 49 is to prevent direct contact between the tube 2 and the damping mass 3.

Figure 5:
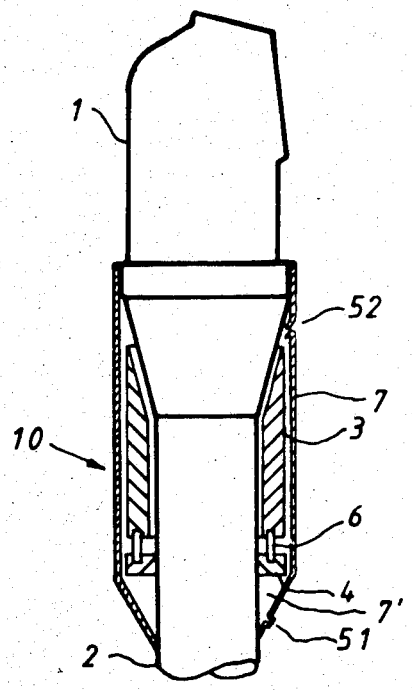
FIG. 5 shows a vertical cross-section of a damping apparatus having a protective sheath which contains openings to facilitate the flow of water.

Referring to FIG. 5, disclosed therein is an embodiment of a damping apparatus 10 provided with a divisible, rotation-symmetrical protective sheath 7. A plurality of lower orifices 51 and upper orifices 52 allow water to flow through an interior of the sheath 7'. The water which flows through the interior of the sheath 7' can exert an additional damping effect by dissipating kinetic energy to minimize vibrations, especially when the periscope is in an extended position. In an alternative embodiment wherein the damping apparatus 10 is located immediately below the periscope's head 1, the sheath 7 may be designed such that the lower orifices 51 and upper orifices 52 are located respectively below and above the surface of the water. By providing a means, not shown, for closing the lower orifices 51, the additional damping effect due to the water may be controlled. For example, a higher damping effect and a low fundamental frequency would be obtained when the sheath 7 is filled with water. A small damping effect and a high fundamental frequency would be obtained when the sheath 7 is empty. Intermediate levels of water would provide corresponding intermediate levels of damping.

Figure 6:
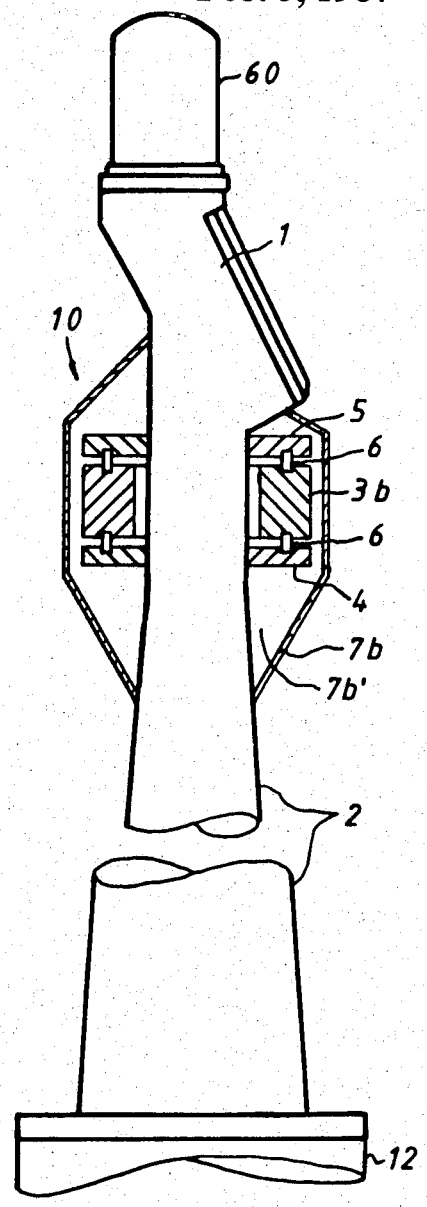
FIG. 6 shows a vertical cross-section of a damping apparatus having a pressure-tight protective sheath.

FIG. 6 shows an embodiment in which an auxiliary apparatus 60, such as an antenna, is mounted on the periscope's head 1. The mass of the auxiliary apparatus 60 must be added to the mass of the periscope when determining the proper size of the damping mass 3. The total mass extending above the surface 13 of the submarine, as shown in FIG. 1, should be within the range previously discussed.

The upper periscope tube 2 in FIG. 6 has a diameter which narrows as the periscope's head 1 is approached. A protective sheath **7*b* is designed to account for the variable diameter of the tube 2 and the unsymmetrical location of the periscope's head 1. The sheath 7*b*** is also designed to facilitate water flow and minimize wake and resistance caused by vertical or horizontal motion for all angular positions of the periscope.

The protective sheath **7*b* may also be designed to be pressure tight at the submarine's maximum submersion depth. The interior of the sheath 7*b'*** can then be filled with an oil or other hydraulic damping fluid. Silicone oil is preferred.

Figure 7:
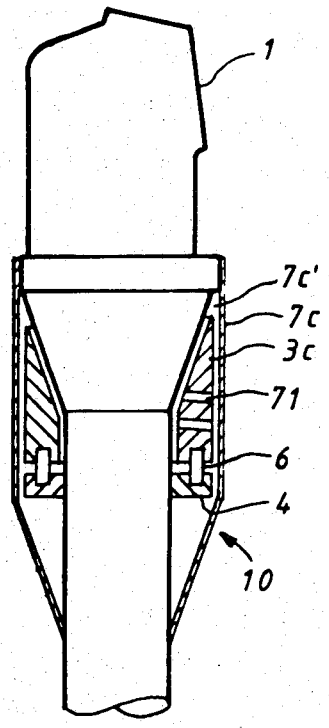
FIG. 7 shows a vertical cross-section having a pressure tight protective sheath for holding a liquid damping medium wherein a damping mass contains openings for facilitating flow of the damping medium.

Referring to FIG. 7, disclosed is a damping apparatus 10, similar to that disclosed in FIG. 3, which is further provided with a pressure-tight, protective sheath **7*c*. An interior of the sheath 7*c'* is preferably filled with silicone oil. A damping mass 3*c* is provided with a plurality of radial channels 71 which increase the damping effect of the silicone oil or other hydraulic damping fluid. The size and shape of the channels 71, together with the size and shape of the interior of the sheath 7*c'*** determine the extent of damping.

Figure 8:
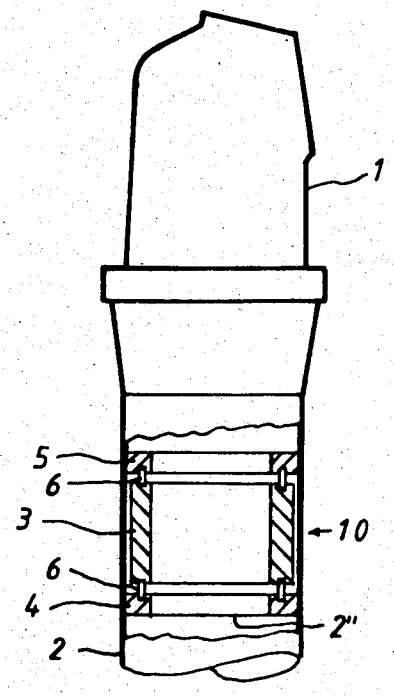
FIG. 8 shows a vertical cross-section of a damping apparatus wherein the apparatus is housed within the periscope tube below the periscope's head.

Disclosed in FIG. 8 is an embodiment of a damping apparatus 10 wherein the damping mass 3 is housed within the upper periscope tube 2. The damping mass 3 is disposed between a top attaching ring 5 and a bottom attaching ring 4 by a plurality of springy elements 6. The attaching rings 4, 5 are securely clamped to an interior surface of the upper periscope tube 2''. This embodiment is advantageous in that it does not require any changes in the external shape of the periscope. However, retrofitting a damping apparatus to fit within a periscope tube would require substantial changes in the design of the devices, including any optical devices housed therein.

Figure 9:
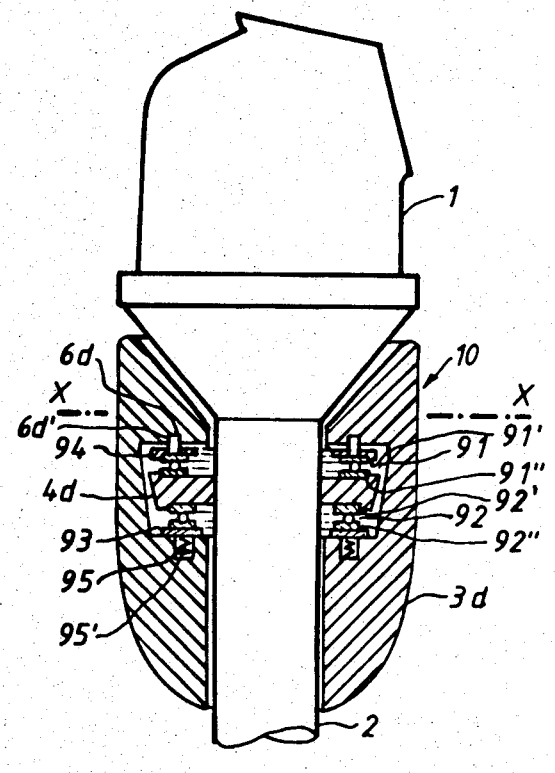
FIG. 9 shows a vertical cross-section of a damping apparatus having a rotatably mounted damping mass shaped in the form of a vane.
Figure 10:
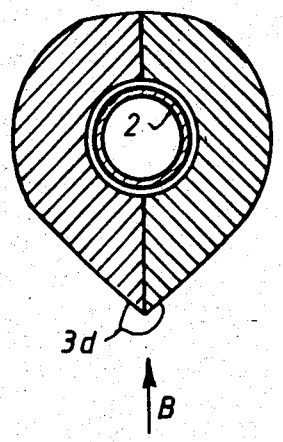
FIG. 10 shows a horizontal cross-section of the damping mass corresponding to the X—X plane of FIG. 9.

FIGS. 9 and 10 show a streamlined damping mass **3*d* which is rotatably mounted on the upper periscope tube 2. The damping mass 3*d* is mounted on a single, annular attaching ring 4*d* by means of upper ball bearings 91 and lower ball bearings 92. Each ball bearing 91 and 92 are disposed respectively between annular ball bearing plates 91', 91'', 92' and 92''. A plurality of springy elements 6*d* exert downward directed pressure on a friction ring 94 which juxtaposes the ball bearing plate 91'. A plurality of springs 95 exert upward directed pressure on a friction ring 93 which is juxtaposed against the ball bearing plate 92'. The springy elements 6*d* and the springs 95 are respectively mounted in recesses 6*d'* and 95' in the damping mass 3*d*. This arrangement allows damped radial movements of the damping mass without impeding the rotation of the damping mass 3*d* around the periscope tube 2. An expanded view of the rotatable damping mass 3*d* is shown in FIG. 10, wherein a two-part construction of the damping mass 3*d*, which facilitates installation and removal of the damping apparatus, is disclosed. The damping mass 3*d* preferably has a streamlined shape in order to optimize the flow of water around it. The rotatable damping mass 3*d* will automatically set itself as shown in FIG. 10** in response to a submarine traveling in the direction indicated by arrow B.

In a further embodiment of the invention, not shown in the drawings, is a damping apparatus as disclosed in FIGS. 9 and 10 which can be height-adjustably mounted on the periscope tube 2 such that the damping apparatus will automatically adjust its position so as to break the surface of the water. The rotatable damping mass **3*d*** will align itself in order to optimize the flow of water, as previously discussed.

Figure 11:
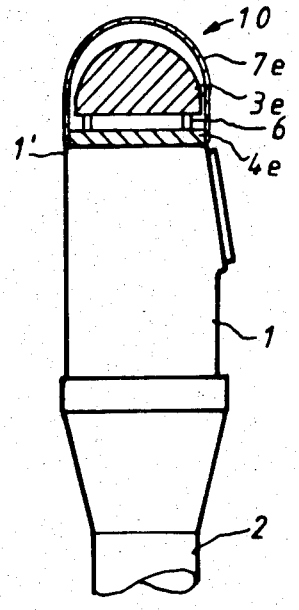
FIG. 11 shows a vertical cross-section of a damping apparatus mounted on top of a periscope's head.

FIG. 11 shows a damping apparatus 10 mounted on a top part of a periscope's head 1'. A damping mass **3*e* is supported by a plurality of springy elements 6, which in turn rest on an attaching element 4*e*. The attaching element 4*e* is securely affixed to the top of the periscope's head 1'. The attaching element 4*e* may be, for example, a ring or a plate. A protective sheath 7*e* is also provided. The protective sheath 7*e* may preferably contain orifices and have means to open and close the orifices. Also, preferably, the sheath 7*e* may be pressure tight and be filled with a hydraulic damping fluid. In another embodiment, the damping mass 3*e*** may contain channels which further affect the overall damping characteristics.

Figure 12:
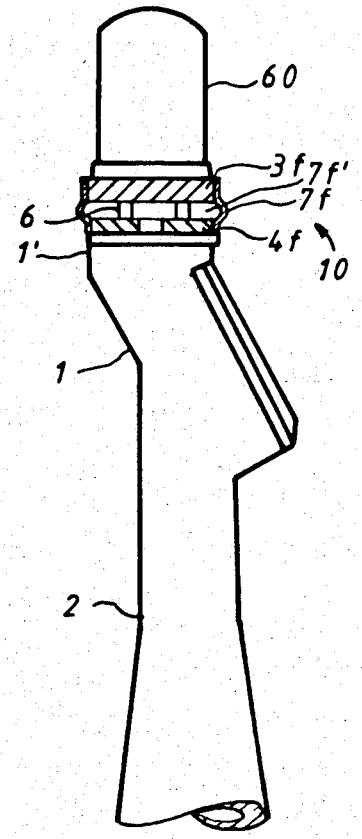
FIG. 12 shows a vertical cross-section of a damping apparatus mounted on top of a periscope's head additionally having a supplementary attachment mounted on top of the damping apparatus.

Referring to FIG. 12, a damping apparatus 10 is mounted on a top part of a periscope's head 1' by means of an attaching ring **4*f*. A damping mass 3*f* is supported by a plurality of springy elements 6. Attached to and on top of the damping mass 3*f* is an auxiliary element 60, which may comprise, for example, a radar warning antenna. The auxiliary element 60 effectively functions as a part of the total damping mass which dampens the vibrations of the periscope. Therefore, the damping mass 3*f* should be made correspondingly lighter in order for the total damping mass to fall within one of the preferred damping mass ranges. Also shown is a protective sheath 7*f* which encloses the damping mass 3*f* and the attaching ring 4*f* and thereby forms an interior portion 7*f'* corresponding to the sheath 7*f*. In this particular application, the protective sheath 7*f* must be flexible and allow for the influx and exhaust of fluids responsive to vibrational damping movement of the damping apparatus 10. When the sheath 7*f*** is watertight, the elements located in the interior 7f' need not be corrosion or sea water resistant.

Figure 13:
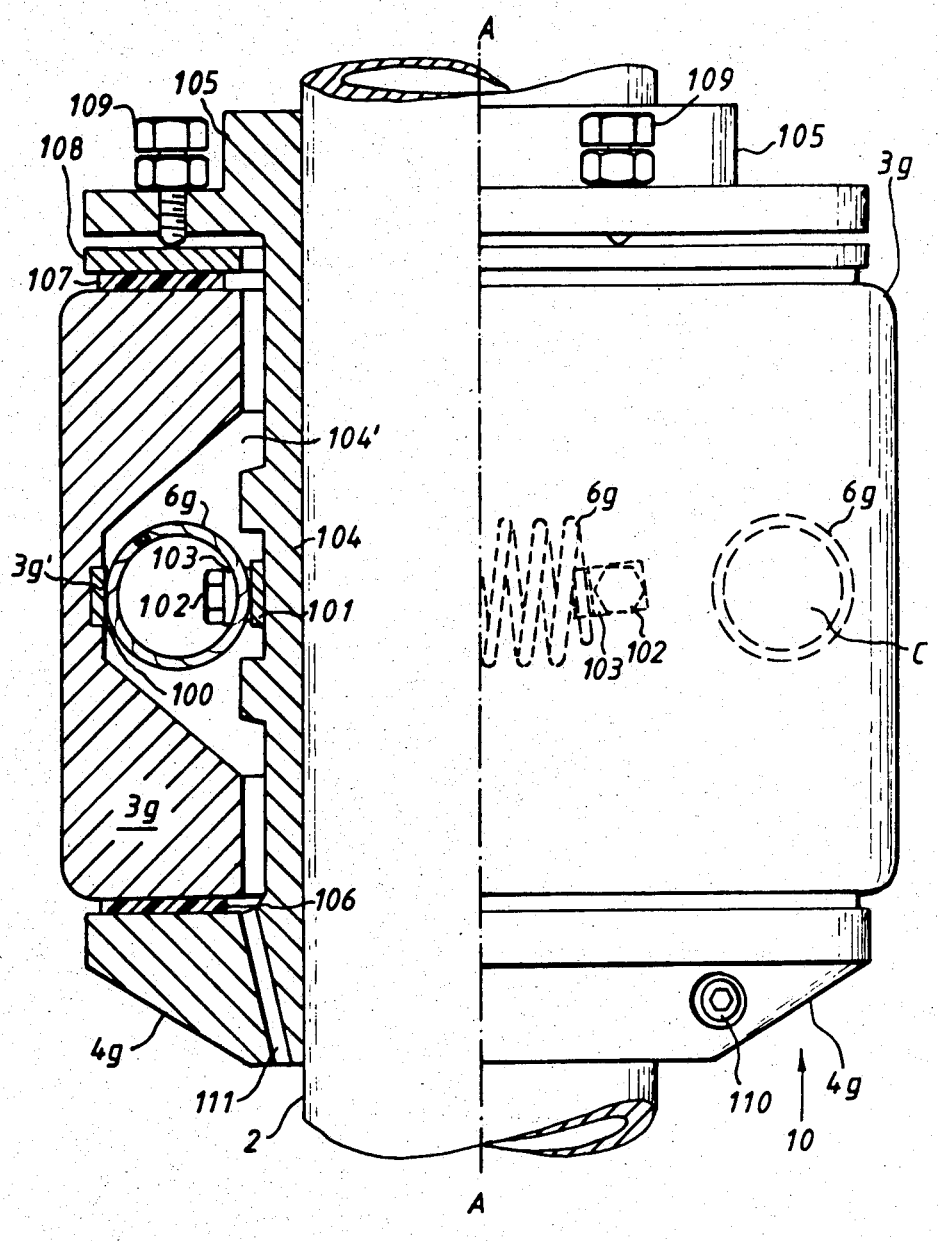
FIG. 13 shows a vertical cross-section of a damping apparatus having helical, metal springs mounted between the periscope tube and the damping mass.

Referring to FIG. 13, disclosed is a damping apparatus 10 having a plurality of helical metal springs 6g which serve as means for mounting a damping mass 3g onto the periscope tube 2. The springs 6g are located in a tubular shaped middle section 104 of the attaching ring 4g. The axis of each spring 6g is perpendicular to the axis A—A of the periscope tube 2. According to this embodiment, four springs 6g located 90° apart from one another around the periscope tube 2 are utilized. Each spring 6g is disposed between a damping mass plate 100 located on an inner surface portion of the damping mass 3g' and an attaching ring plate 101 which is in turn connected to the middle section 104 of the attaching ring 4g. Each spring 6g is secured by means of two (2) screws 102. Each screw 102 passes through a washer 103 that is securely attached to the spring 6g. Each screw 102 is rotatably fastened into a threaded channel, not shown, located in the attaching ring plate 101. Alternatively, each screw 102 can be rotatably fastened into threaded channels located in the damping mass plate 100. In response to radial movements of the damping mass 3g, the springs 6g are deflected out of their neutral positions and are alternately stressed in tension and pressure. This radial movement also subjects a circular cross-sectional area C of each spring 6g to deformation wherein the direction of movement comprises a vector at a right angle with an axis of the spring 6g which is perpendicular to the cross-sectional area C.

As previously mentioned, more than four springs may be employed according to this embodiment. Alternatively, a single, ring-shaped spring 6g which encircles the entire middle portion 104 of the attaching ring 4g may be provided.

The springs 6g should be made from materials which are resistant to sea water corrosion, e.g., stainless steel. When the springs 6g and other components of the damping apparatus 10 are also corrosion resistant, a protective sheath is not necessary to prevent corrosion. However, a protective sheath may still be useful for streamlining the damping mass.

The springs 6g are preferably comprised of a plurality of narrow wire strands wound together to form the spring. This type of construction results in good damping characteristics, due in part to friction between the individual wire strands. The springs 6g may alternatively be comprised of a unitary solid wire.

Further damping may be achieved by setting the damping mass 3g on top of a friction pad 106 which is horizontally positioned between the lower horizontal surface of the damping mass 3g and the corresponding horizontal surface of the attaching ring 4g. Pressure is applied from above the damping mass 3g by screws 109 which passes through the upper portion 105 of the attaching ring 4g and acts on a pressure ring 108. The pressure ring 108 is consequently pressed down on a friction pad 107 which juxtaposes the top horizontal surface of the damping mass 3g. The pressure applied to the friction pads 106, 107 is controlled with the screws 109, thereby controlling the degree of damping.

The damping mass 3g is constructed of two parts which are firmly held together and clamped on to the periscope tube 2 by means of screws 110. Cylindrical channels 111 are provided in the attaching ring 4g to allow water to exit the interior portion 104' between the damping mass 3g and the middle portion 104 of the attaching ring 4g.

The following example discloses an application of one particular embodiment of the present invention.

EXAMPLE

Figure 14:
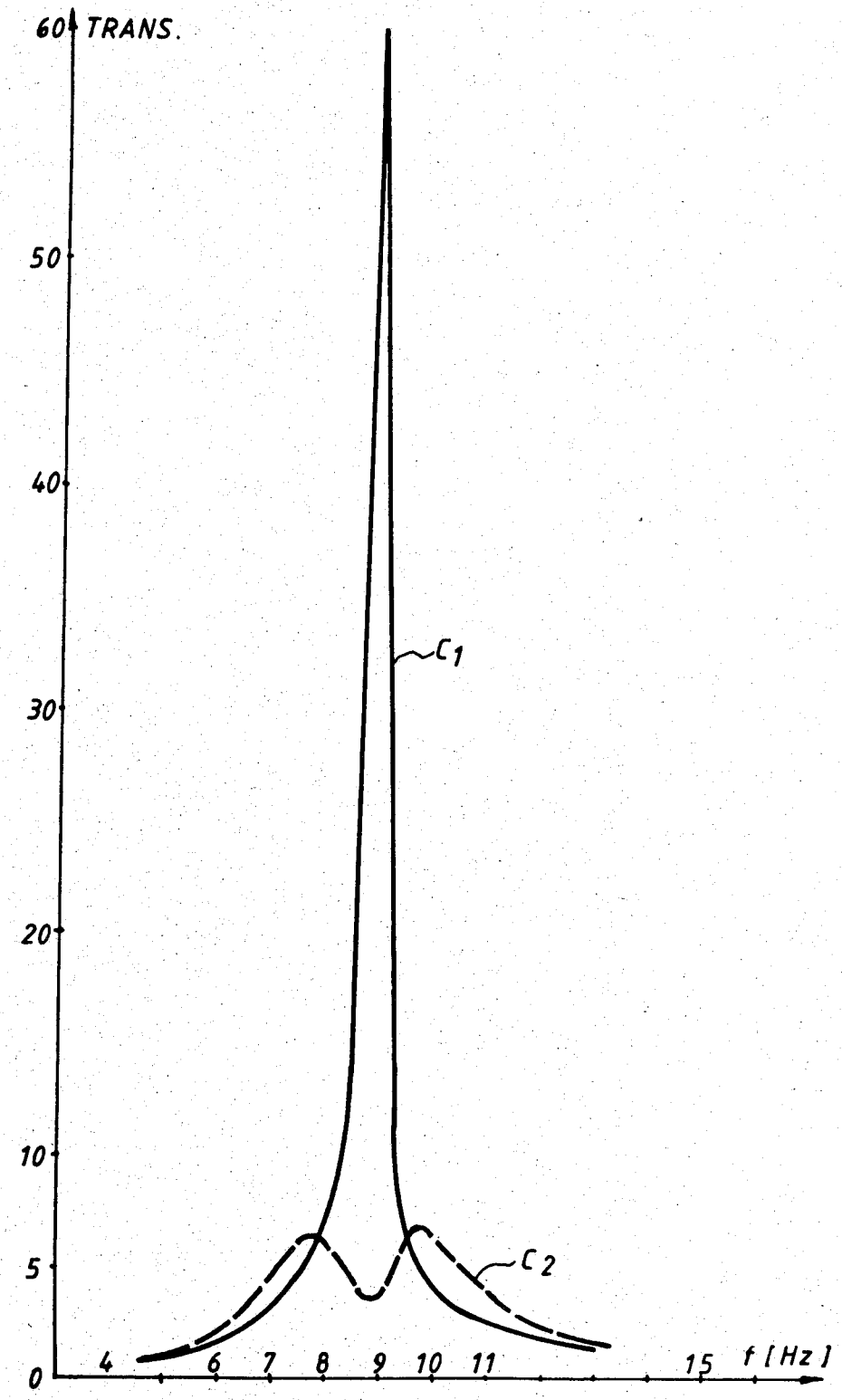
FIG. 14 is a diagram which shows the frequency-dependent behavior of a periscope with a damping apparatus and a periscope without a damping apparatus.

At the speed of the submarine during periscope use only one resonant frequency was observed. The periscope having an extended length of 4.2 meters, an upper support bearing of a submarine, was fitted with a damping apparatus immediately below the periscope's head. The particular damping apparatus embodiment is shown in FIG. 1. The mass of the extended portion of the periscope was 260 kilograms. The extended periscope tube had a natural frequency of about 8.8 Hz. The damping mass had a mass of about 6.2 kilograms and a natural frequency of about 8 Hz. The damping mass was supported by four rubber springy elements each having a diameter of 15 mm. The rubber hardness was 55 Shore. By computation, the effective damping was 16.8% of critical damping. FIG. 14 shows the TRANS factor, which is a factor indicating a degree of resonance, as a function of vibrational frequency for a periscope without damping C1 and with 16.8% effective damping C2. Without damping, the maximum TRANS factor was 60 at 8.8 Hz. With damping of up to 6.5, the TRANS factor at 8.8 Hz was about 3.5. Peak TRANS values were observed for the damped periscope at the frequencies of 7.8 Hz and 9.7 Hz. These values were higher than the TRANS values for the undamped system at corresponding frequencies. However, the resonant peaks at 7.8 Hz and 9.7 Hz were very much less than that of the original undamped system at 8.8 Hz.

For an undamped maximum deflection of 40 mm, which corresponds to a TRANS factor of 60, the damped system reduced the maximum deflection to about 4.5 mm. This reduction in maximum deflection represents a notable improvement in the vibratory behavior of the periscope. It should be noted, however, that the true optimum damping level and damping apparatus embodiment, for a particular application, will be dependent on various factors which may parameters, specifications, traveling conditions, include the design of the submarine or other vessel, the pressure and design of other equipment extending from the submarine or vessel and the particular travel conditions. Additional factors which should be considered include the capabilities of the manufacturer and any specific requirements of the user.

The invention is not to be taken as limited to all the details that are described hereinabove, since modifications and variations thereof may be made without departing from the spirit or scope of the invention.

What is claimed is:

1. An apparatus for a submarine which damps vibrational deflections of a periscope which is extendable from and retractable into said submarine when in use in an aqueous medium about said submarine, said periscope having:

an uppermost portion and a lower portion;

said damping apparatus being mounted at said uppermost portion of said periscope, said damping apparatus comprising:

damping mass means for storing kinetic energy and potential energy resulting from vibrational deflections of said periscope;

said damping apparatus for damping said vibrational deflections of said periscope, when said submarine is in motion, with respect to said aqueous medium;

at least one damping element for damping the stored energy of said damping mass means;

means for mounting said damping apparatus onto said periscope;

said damping mass means and said at least one damping element being moveable mounted at said mounting means, whereby said damping mass means is subject to vibratory deflection in response to vibrating deflection of said periscope;

said damping mass means comprising at least one damping mass for being disposed at said uppermost portion of said periscope;

said submarine having a superstructure for withdrawing said periscope thereinto;

said submarine superstructure having an uppermost bearing for holding said lower portion of said periscope when extended; and said damping apparatus, when withdrawn with said periscope into said submarine superstructure, fitting within said uppermost bearing.

2. The apparatus as in claim 1, wherein said at least one damping mass is rotatably mounted on said periscope.

3. The apparatus as in claim 1, wherein said at least one damping element comprises at least one lossy, springy element.

4. The apparatus as in claim 1, wherein said at least one damping element comprises at least one friction damper.

5. The apparatus as in claim 4, wherein said periscope comprises a rotatable periscope.

6. The apparatus as in claim 5, wherein said persicope has a head and said damping apparatus is mounted on said periscope immediately below said head.

7. The apparatus as in claim 6, wherein said damping apparatus is mounted onto said uppermost portion of said periscope immediately below said head of said periscope.

8. The apparatus as in claim 7, wherein said damping apparatus is mounted inside the upper tube of the periscope.

9. The apparatus as in claim 1, further comprising a protective sheath, said sheath housing said at least one damping element and said at least one damping mass within an interior portion of said sheath.

10. The apparatus as in claim 9, wherein said sheath is pressure tight.

11. The apparatus as in claim 10, wherein said interior portion of said sheath contains a hydraulic damping fluid.

12. The apparatus as in claim 9, wherein said sheath further includes a plurality of orifices, whereby said orifices facilitate inflow and outflow of the aqueous medium.

13. The apparatus as in claim 9, wherein said at least one damping element is disposed between said mounting means and said at least one damping mass.

14. The apparatus as in claim 1, wherein said at least one damping mass comprises an annular damping mass disposable around a portion of said periscope which is extended, in use, into said aqueous medium.

15. The apparatus as in claim 14, wherein said annular damping mass has an inner surface and said periscope has an outer surface, and wherein said at least one damping element is disposed between said inner surface of said annular damping mass and said outer surface of said periscope.

16. The apparatus as in claim 1, wherein said mounting means comprises at least one attachment ring, said damping mass means and said at least one damping element being movably mounted into said attachment ring, whereby said damping mass means is subject to vibratory deflection in response to vibrating deflection of said periscope.

17. The apparatus as in claim 16, wherein said at least one damping mass is from about 0.5% to about 10% of the mass of the portion of said periscope which is extended into said aqueous medium when in use.

18. The apparatus as in claim 1, wherein said damping apparatus has a damping effect of from about 10% to about 30% of critical damping.

19. The apparatus as in claim 1, wherein said damping apparatus is annular and is disposed around an outside surface of said uppermost portion of said periscope.

20. The apparatus as in claim 1, wherein said periscope has a head and said damping apparatus is mounted on said head of said periscope.

21. The apparatus as in claim 1, wherein said at least one damping element includes springy means and frictional means for damping said vibrational deflections of said periscope.

* * * * *